US007255345B2

(12) United States Patent
Wood et al.

(10) Patent No.: US 7,255,345 B2
(45) Date of Patent: Aug. 14, 2007

(54) ADVANCED GAMES AND PUZZLES

(75) Inventors: Mark Thornton Wood, Nerang (AU); Francis Henry Dyksterhuis, Laravale (AU)

(73) Assignee: Global on Puzzles Pty Ltd, Bundall, Queensland (AU)

( * ) Notice: Subject to any disclaimer, the term of this patent is extended or adjusted under 35 U.S.C. 154(b) by 0 days.

(21) Appl. No.: 10/488,417

(22) PCT Filed: Aug. 29, 2002

(86) PCT No.: PCT/AU02/01179

§ 371 (c)(1),
(2), (4) Date: Jul. 7, 2004

(87) PCT Pub. No.: WO03/018152

PCT Pub. Date: Mar. 6, 2003

(65) Prior Publication Data

US 2004/0239029 A1 Dec. 2, 2004

(30) Foreign Application Priority Data

Aug. 30, 2001 (AU) ..... PR7368

(51) Int. Cl.
*A63F 9/10* (2006.01)

(52) U.S. Cl. ..... 273/157 R

(58) Field of Classification Search ..... 273/153 R, 273/157 R, 160, 156

See application file for complete search history.

(56) References Cited

U.S. PATENT DOCUMENTS 231,693 A * 8/1880 Luers ..... 100/214

1,752,248 A * 3/1930 Fransen ..... 273/157 R (Continued)

OTHER PUBLICATIONS

Kim, Scott, Games, "Convex Concave", Oct. 1993, pp. 20, 21.*

*Primary Examiner*—Steven Wong
(74) *Attorney, Agent, or Firm*—Mayer & Williams PC; Mark D. Wieczorek, Esq.; Karin L. Williams, Esq.

(57) ABSTRACT

A game or puzzle comprising a plurality of polyomino pieces, each piece having on opposite faces one or more squares, said squares on each said piece and on opposite faces having markings wherein such said markings of said squares in total on both faces of said pieces comprise four or more different markings such that the pieces are capable of being assembled using their obverse faces only into a first set of one pattern comprising squares with the markings of the squares on the obverse faces of the assembled pieces forming a checkerboard pattern of two alternating markings which may be used for playing a checkers or chess type game, and the pieces may be further assembled into a second set of one or more patterns using the reverse faces of some of the pieces and the obverse faces of the remaining pieces, each pattern in the second set comprising squares forming a further checkerboard pattern of four or more markings, one of said markings being in an alternating checkerboard pattern with the remaining markings; the pieces may be further assembled into a third set of patterns using the reverse faces only of the pieces such that each pattern in the third set comprises thee different markings on the reverse side which can be arranged into a pattern such that one of the markings forms a checkerboard pattern with the other two markings; and wherein the assembly of pieces forming the first set of patterns is different from the assembly required of pieces forming the second set of patterns.

23 Claims, 9 Drawing Sheets

U.S. PATENT DOCUMENTS 2,170,909 A * 8/1939 Moren ..... 273/157 R
3,964,749 A * 6/1976 Wadsworth ..... 273/157 R
5,403,005 A * 4/1995 Avila-Valdez ..... 273/157 R
5,740,243 A * 4/1998 Rehm ..... 273/153 R
5,868,388 A * 2/1999 Wood et al. ..... 273/157 R
6,666,453 B2 * 12/2003 Chambers ..... 273/157 R
6,817,614 B2 * 11/2004 Ibbertson ..... 273/292

* cited by examiner

179 *EIGHTEEN PIECE CHECKERBOARD PUZZLE No. 18.1*

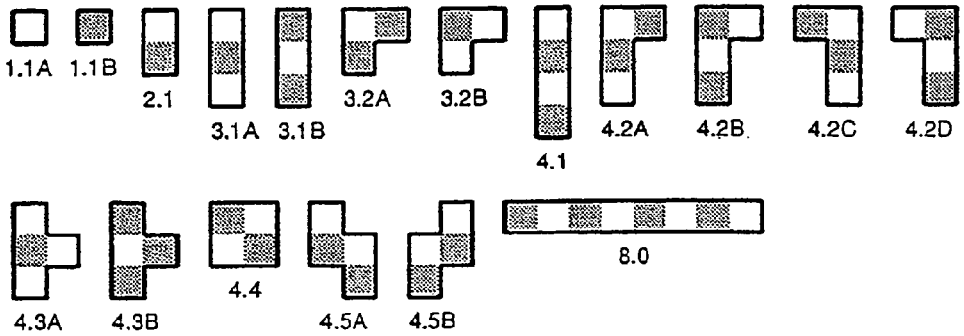

18.1 Dissection Puzzle

Title: Dr. Laskers Chessboard

In *'Puzzle Magazine'* (April-July 1908), and twice in his *'Cyclopedia of 5000 Puzzles, Tricks and Conundrums'*, Sam Loyd posed the problem of dissecting a chessboard into the maximum number of pieces, all different in size, shape or colouring, given that the board is marked with chequered squares on one side.

The maximum number of pieces is 18, though there are many different sets of 18 pieces.

The set shown here is the set given by Sam Loyd.

Out of the numerous (estimate: 20,000,000,000) solutions, 4 are shown here.

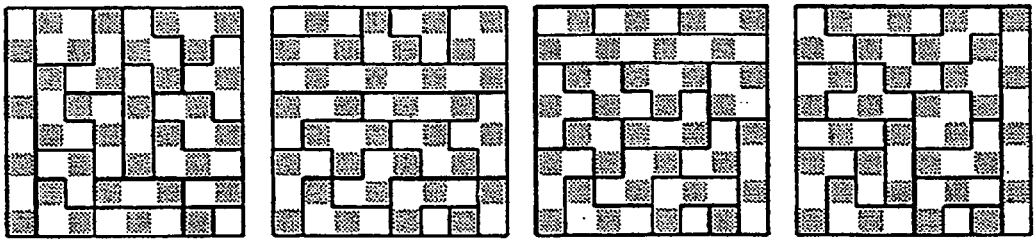

Loyds solution

References: (1) Sam Loyd, *Cyclopedia of 5000 Puzzles, Tricks and Conundrums*, (p. 221, 250)

(2) Sam Loyd, *A Dissection Novelty*, Red Magic Section, Oct. 25, 1925 (p. 1)

(3) G.P. Jelliss, *Chessics*, The Journal of Generalised Chess, Winter 1986

(4) Henry E. Dudeney, "The Chinese Chessboard", *Amusements in Mathematics*, (p. 87)

(5) Boeken voor Jongens en Meisjes, No. 187, *Puzzels en Problemen* (Dutch) Hepkema & Van der Velde, Leeuwarden

Fig. 12

ADVANCED GAMES AND PUZZLES

FIELD OF INVENTION

This invention relates to improved games and puzzles and in particular to advanced games and puzzles, and in particular to game or puzzles which may be considered to be more advanced than the games and/or puzzles described in our U.S. Pat. No. 5,868,388, ("the '388 patent") the specification of which is incorporated herein by reference.

BACKGROUND ART

Checkerboard puzzles of many types have been demonstrated in the past, the inventors being of the view that the main reference giving details of checkerboard puzzles is the "Compendium of Checker Board Puzzles" by Jerry Slocum and Jacques Haubrich published August 1993. Many puzzles may be constructed using the theory of combinatorial geometry upon which the puzzles shown in this Compendium are based. However, no relationship had been established between the obverse side and the reverse side of such puzzles until the '388 patent emerged in which a puzzle was taught having a plurality of polyomino pieces, each of which has on opposite sides one or more squares, the squares on each piece having markings such that the pieces are capable of being assembled using their obverse sides only into a first set of one or more solutions comprising a square checkerboard pattern with the markings of the squares on the obverse side, and wherein the pieces may be further assembled into a second set of one or more solutions comprising a further checkerboard pattern of two alternate markings, the markings on both sides of the pieces comprising three or more different markings and wherein the solutions of the first set are different from the solutions of the second set.

The '388 patent also provided a description of how this principle could be carried further to three-dimensional puzzles, in particular, a cube having, of course, square sides, but each side having a checkerboard pattern such that two opposite sides have the same features of the two sided puzzles of that invention, and pieces being so marked that the sides of the cube when assembled may have a checkerboard pattern comprising the markings carried by the obverse and reverse sides.

However, using the system proposed in the '388 patent, it is not possible to produce some particular checkerboard patterns using only two alternating colours per side to get, for example, diagonal stripes, particularly as applied to twelve pentomino plus one tetromino checkerboards. Where letters, numbers or other symbols having linguistic properties are provided in the place of coloured markings, there is no teaching of a paradigm for the production of particular non-exclusive solutions having a comprehensible statement or message.

It is an object of the present invention to provide advanced games and puzzles which alleviate one or more of the shortcomings of prior art. Other objects and advantages of the invention may become apparent from the following description.

DISCLOSURE OF THE INVENTION

With the foregoing in view, the present invention in one aspect resides broadly in a game or puzzle comprising a plurality of polyomino pieces, each piece having on opposite faces one or more squares, said squares on each said piece and on opposite faces having markings wherein such said markings of said squares in total on both faces of said pieces comprise four or more different markings such that:

said pieces are capable of being assembled using their obverse faces only into a first set of one pattern comprising squares with the markings of the squares on said obverse faces of said assembled pieces forming a checkerboard pattern of two alternating markings which may be used for playing a checkers or chess type game;

said pieces may be further assembled into a second set of one or more patterns using the reverse faces of some of the pieces and the obverse faces of the remaining pieces, each pattern in said second set comprising squares forming a further checkerboard pattern of four or more markings, one of said markings being in an alternating checkerboard pattern with the remaining markings; and said pieces may be further assembled into a third set of patterns using the reverse faces only of said pieces such that each pattern in said third set comprises three different markings on said reverse side which can be arranged into a pattern such that one of said markings forms a checkerboard pattern with the other two markings;

wherein the assembly of pieces forming said first set of patterns is different from the assembly required of pieces forming said third set of patterns.

In a preferred form, the polyominoes are selected as to their respective shapes and checkered pattern on the obverse face in accordance with those set forth by Sam Lloyd on page 179 of the Compendium referred to above. However, by selecting particular checkered pattern on the reverse faces of the pieces in accordance with the present invention (rather than merely duplicating the checkerboard pattern on every piece in the same, reverse, or alternative markings), it has surprisingly been found that in spite of there being over twenty billion solutions to the checkerboard pattern on the obverse face, there are arrangements where a unique solution to the puzzle can be demonstrated. By unique, it is meant that there is only one arrangement of pieces that allow the particular pattern. For example, one unique solution can be demonstrated comprising a striped pattern similar to that of the third set of patterns of the present invention, but where the stripes of two of the markings are incomplete across in the diagonal direction of the board. There may be other patterns with unique solutions, and indeed, it is believed that there is a significant number of patterns having unique solutions.

It is further believed that puzzles according to the present invention have the advantage that there are very simple solutions to the plain checkerboard puzzle in the first pattern. In other words, solutions to the checkerboard pattern of the first set may be selected to be very easy to find. In all other sets, solutions can be selected to be of a graded degree of difficulty for solving the game or puzzle. In such form, which will be referred to hereinafter as the "kaleidoscope board", where the markings are selected from four different colours, one of which is common to both faces, there is possible a fourth set of patterns which are not checkerboard puzzles, but could be selected to be aesthetically pleasing patterns. It will be seen that the incomplete striped pattern is from the third set of patterns. In terms of numbers, it is envisaged that there would be tens of thousands of patterns in the third set, and possibly millions of patterns in the second set for this particular embodiment, which will be described in more detail below in the description of the accompanying drawings.

In another aspect the present invention resides broadly in a game or puzzle comprising a plurality of polyomino pieces having an obverse face and a reverse face and squares having markings on each said face, wherein each puzzle piece is configured to a height the same dimension as the side of the squares making up the polyominoes such that the polyominoes are made up of a number of abutting cubes and having side faces made up of abutting squares, the markings on reverse and obverse faces and the side squares being selected to provide an indicium in at least some of said squares, such that the puzzle pieces may be assembled into one or more solutions comprising an assembled cube having a number of squares along each edge corresponding to the number of squares on the obverse and reverse faces, wherein at least one of said solutions comprises one or more messages on at least one of said faces of said assembled cube, said one or more messages being comprised of at least some of said indicia in said squares.

In a preferred form, the puzzle pieces are all hexominoes comprising the entire universe of all thirty-five different planar configurations that can be formed from six squares, each puzzle piece being configured to a height the same dimension as the side of the squares making up the hexominoes such that the hexominoes are made up of six abutting cubes, and a further hexomino configured to have one of its cubes extending out of the planar dimension and into the third dimension or alternatively, the three-dimensional hexomino being substituted by two triominoes of different configuration (there being only two different configurations for triominoes); the hexominoes having squares having different marking on each face, the markings being selected to provide an indicium in at least some of the squares such that the puzzle pieces may be assembled into one or more solutions comprising an assembled cube having six squares along each edge, wherein at least one of the solutions comprises one or more messages on at least one of the faces of the assembled cube, the one or more messages being comprised of the indicia in the squares.

The message may comprise patterns of colours wherein the indicia in each consist of a number of colours as hereinbefore described. Preferably, however, the indicia are in the form of language characters for the assembly of one or more verbal messages. In such form, "Rosettes" of particular patterns may be provided by the appropriate selection of characters and their respective arrangements on the squares so that the word or words are readable even though the cube may be turned to different orientations. The message or messages would typically be relatively short, such as proverbs or saying using letters of the alphabet in languages such as English, or may be in the form of a magic square wherein the indicia are in the form of numerals, or may be a longer passage of prose or poetry in an ideographic language, such as Chinese, Japanese, Korean etc. When the characters are provided in the form of Rosettes, it is preferred that a mask be provided having apertures in register with one of the letters of each Rosette to place over the face of the cube in order to render the message more clearly. It can be seen that by use of Rosettes in conjunction with the mask, the power of the three-dimensional aspect of the puzzle of the present invention can be rendered into an intelligible message irrespective of the orientation of the letters which can be used to compose a message. When a mask is provided for each face of the cube, intelligible messages can be readily seen when assembled on each face.

In another aspect, the present invention resides broadly in a method of exploiting a puzzle as herein described including:

selecting an arrangement of four different markings on the squares of the polyominoes;

publishing the arrangement of the polyominoes for a price;

offering a reward for the provision of a solution of any set of solutions, wherein the reward increases periodically to a maximum reward amount.

Preferably, the publication is by way of an Internet website and the price is payable in order to gain access to the arrangement of the polyominoes and/or a website form for uploading a proposed pattern to the third set of patterns. A relatively small reward may be provided for the uploading of a new (that it, previously unpublished) solution from the first set of patterns, and an intermediate reward may be provided for the uploading of a pattern from the second set of patterns. In such form, the reward may be set to increase at, say for example, US$1,000.00 per day, and the maximum reward may be set at, say for example, US$1,000,000.00.

Preferably, since two dimensional versions of the present invention such as the kaleidoscope board may be subjected more easily to numerical analysis, the type of puzzle made the subject of the reward system is the three-dimensional, cubic version of the invention.

It will be appreciated that there may be many specialised effects possible using as-yet undiscovered phenomena of the puzzle of the present invention Some effects that have been discovered, in the Kaleidoscope board for example, include patterns which are "double sided", that is, having aesthetic patterns on both sides for a given solution. However, only one side can be solved as a checkerboard pattern for each solution. Additionally, some solutions may produce patterns which are reversible by direction or colour or both direction and colour. It may be possible to determine solutions having patterns which can be rotated or reversed in mirror image fashion. Moreover, in order to determine or characterise such specialised effects, rules, principles or mechanisms may be discoverable to enable the determination of further patterns for such specialised effects.

In the case of the three-dimensional form of the invention, there would be only some cases where the patterns are reversible. If the letters forming a word at one location on one face of the cube are all on separate pieces and in each case, the letters are located on the one-square face of the piece, it is possible to provide a solution which is in the opposite location on that face of the cube. Of course, there may be other solutions which could provide this effect. Further examples may include, but are not limited to, solutions which form a crossword and for which clues may be given as to the actual words making up the solution, and messages which are encrypted. Furthermore, the ease with which the encryption may be solved can be selected in accordance with similar principles used to select other word-type solutions described herein.

BRIEF DESCRIPTION OF TEE DRAWINGS

In order that the invention may be more readily understood and put into practical effect, reference will now be made to the accompanying drawings which illustrate some preferred embodiments of the invention, and wherein.

Figure 1:
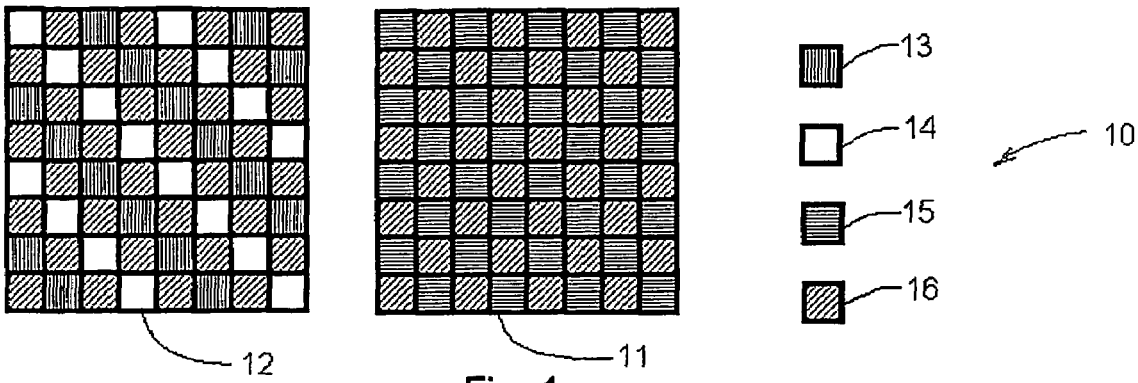
FIG. 1 shows the obverse and reverse faces of a puzzle referred to herein as the "kaleidoscope board" according to the invention.
Figure 2:
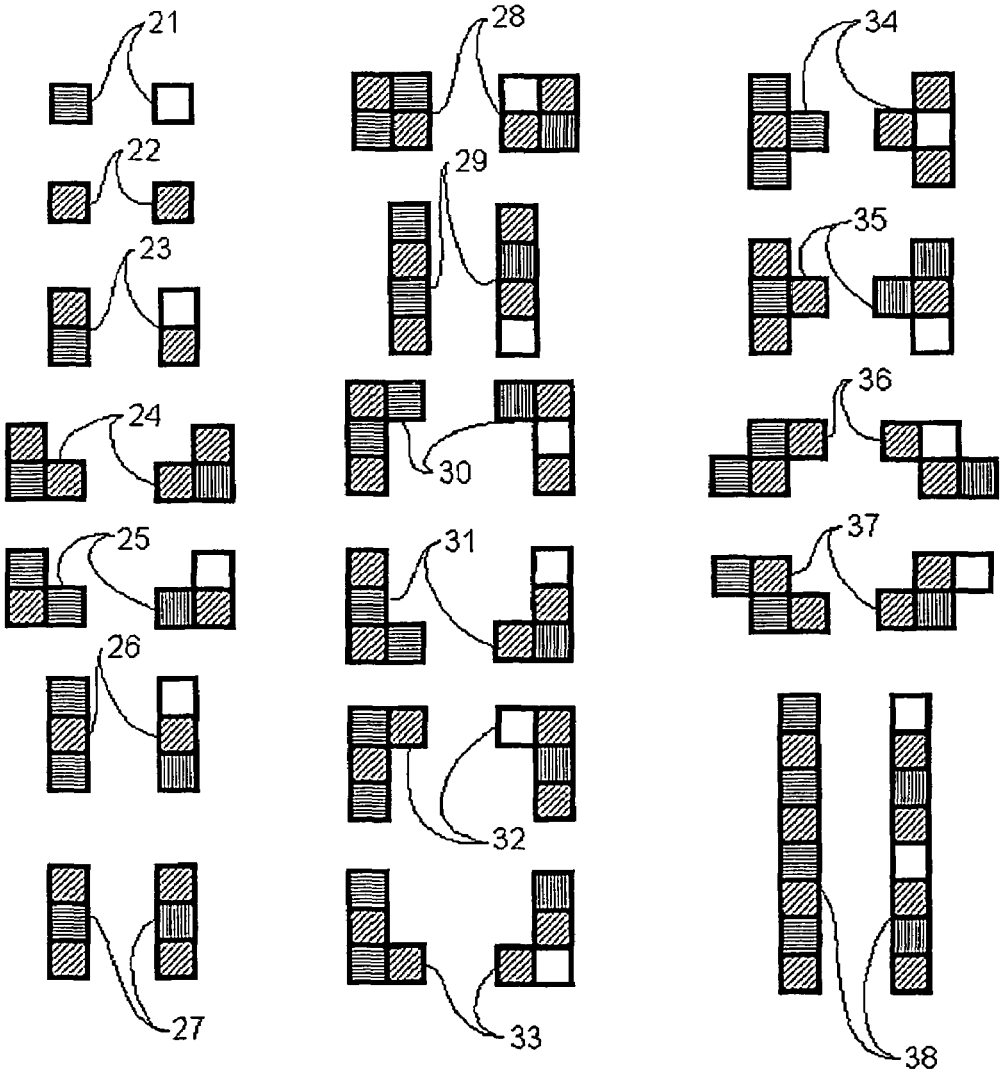
FIG. 2 shows collectively the eighteen pieces (both faces) which make up the puzzle of FIG. 1.
Figure 4:
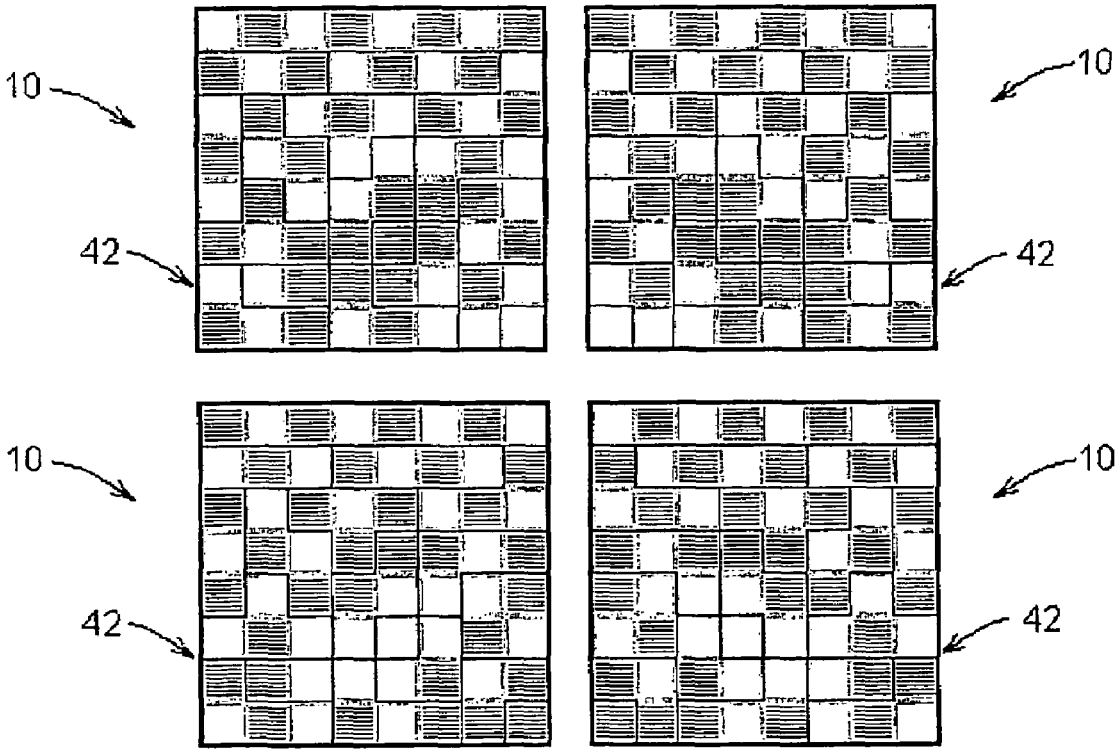
Figure 5:
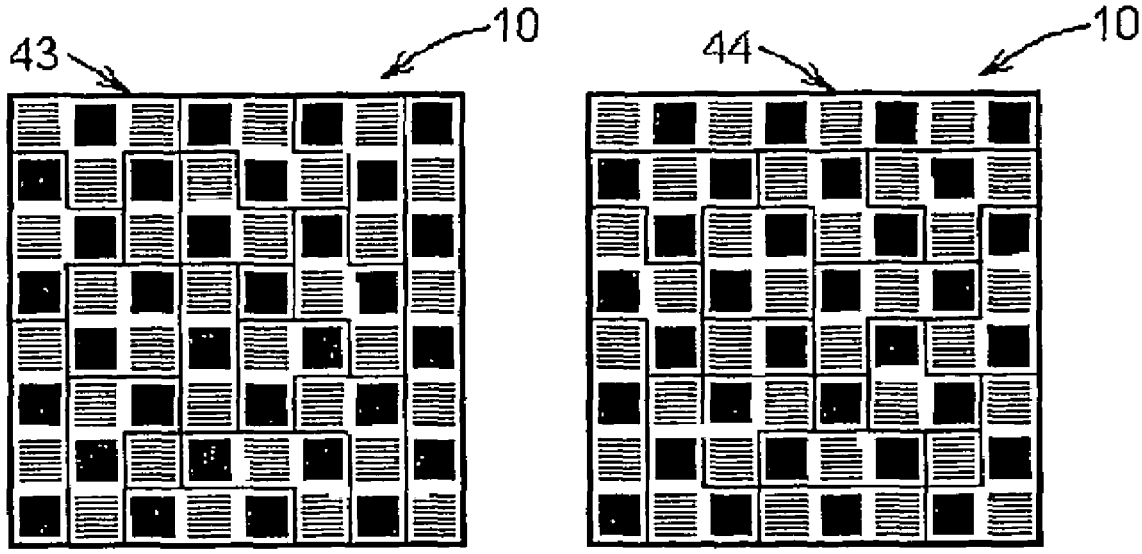
Figure 6:
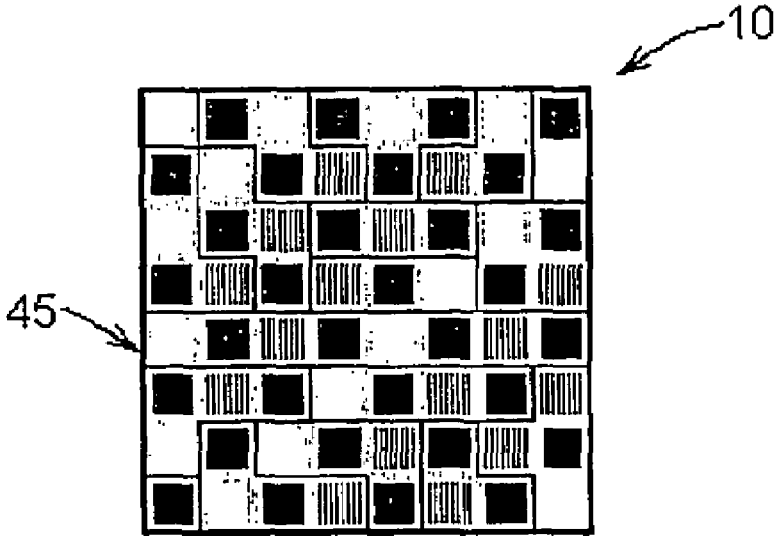
Figure 7:
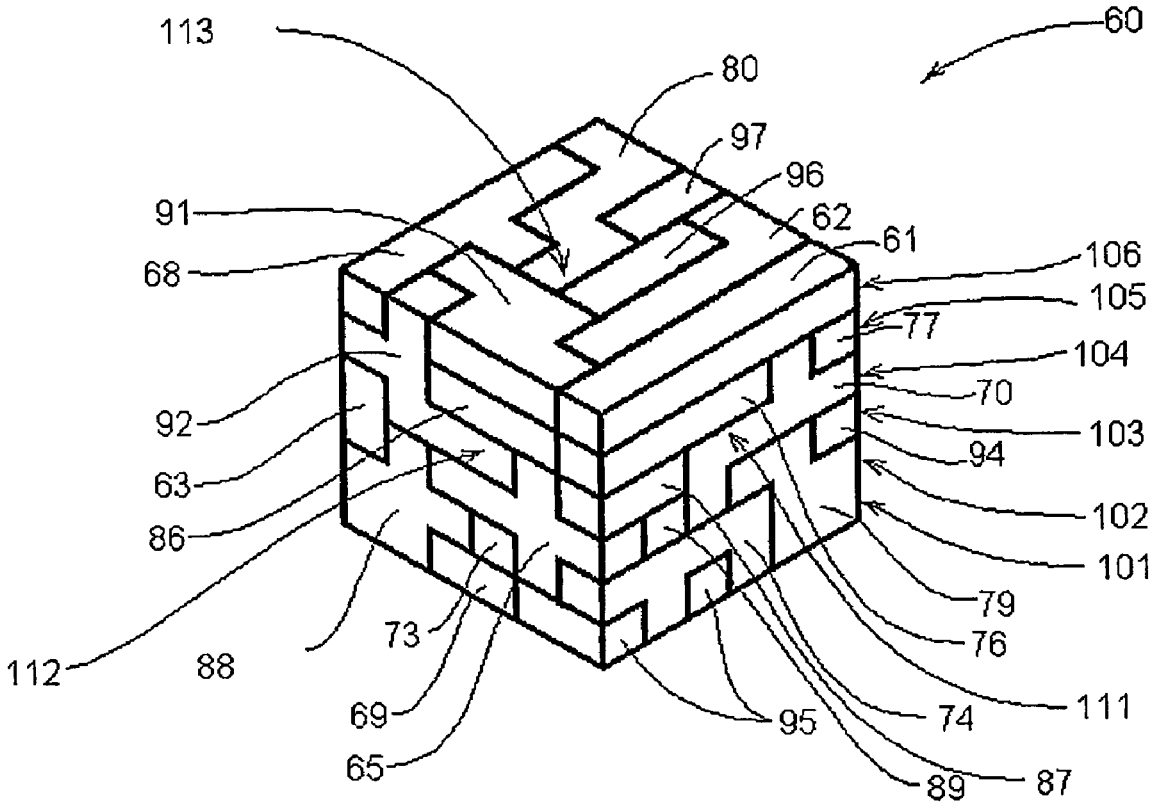
Figure 8:
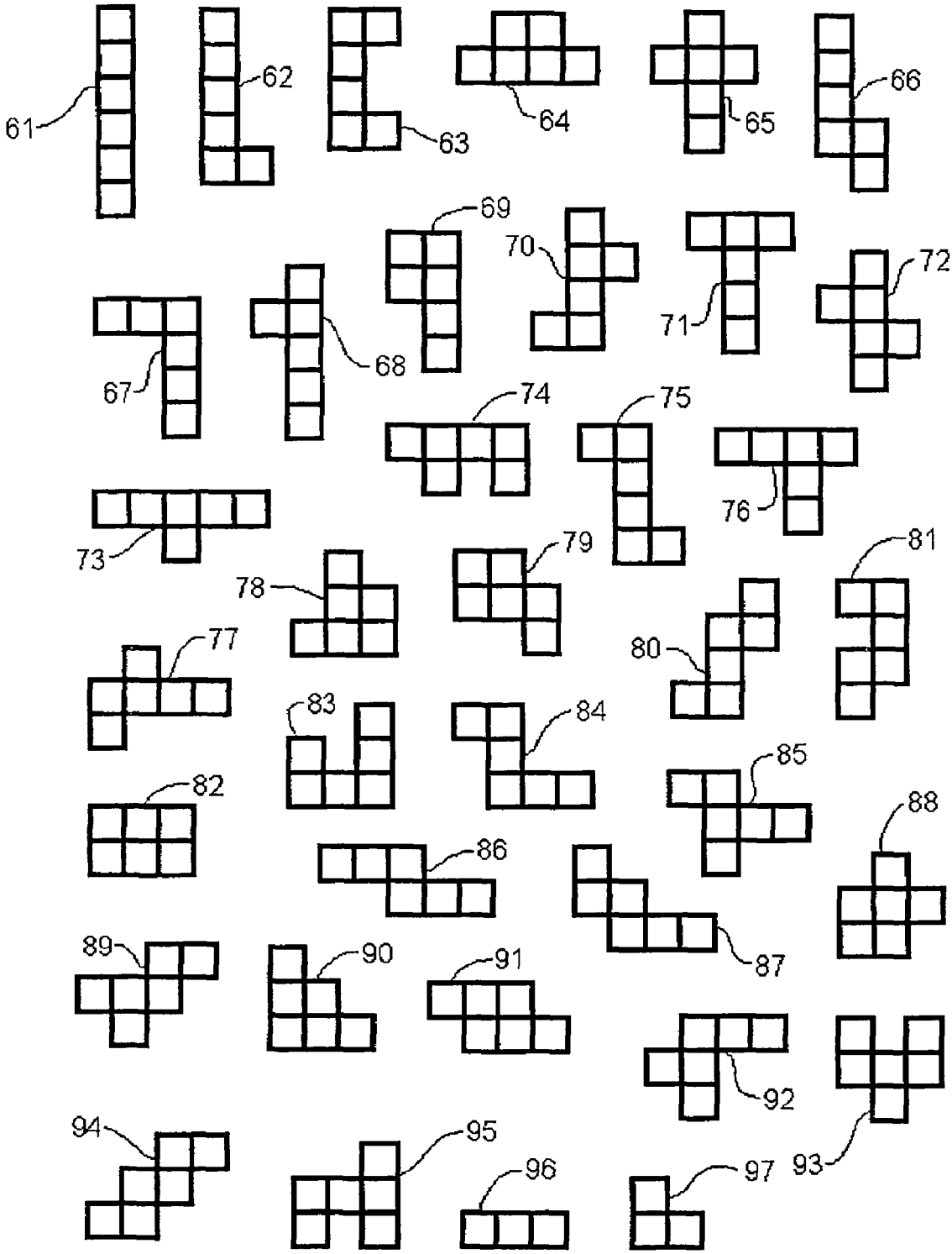
Figure 9:
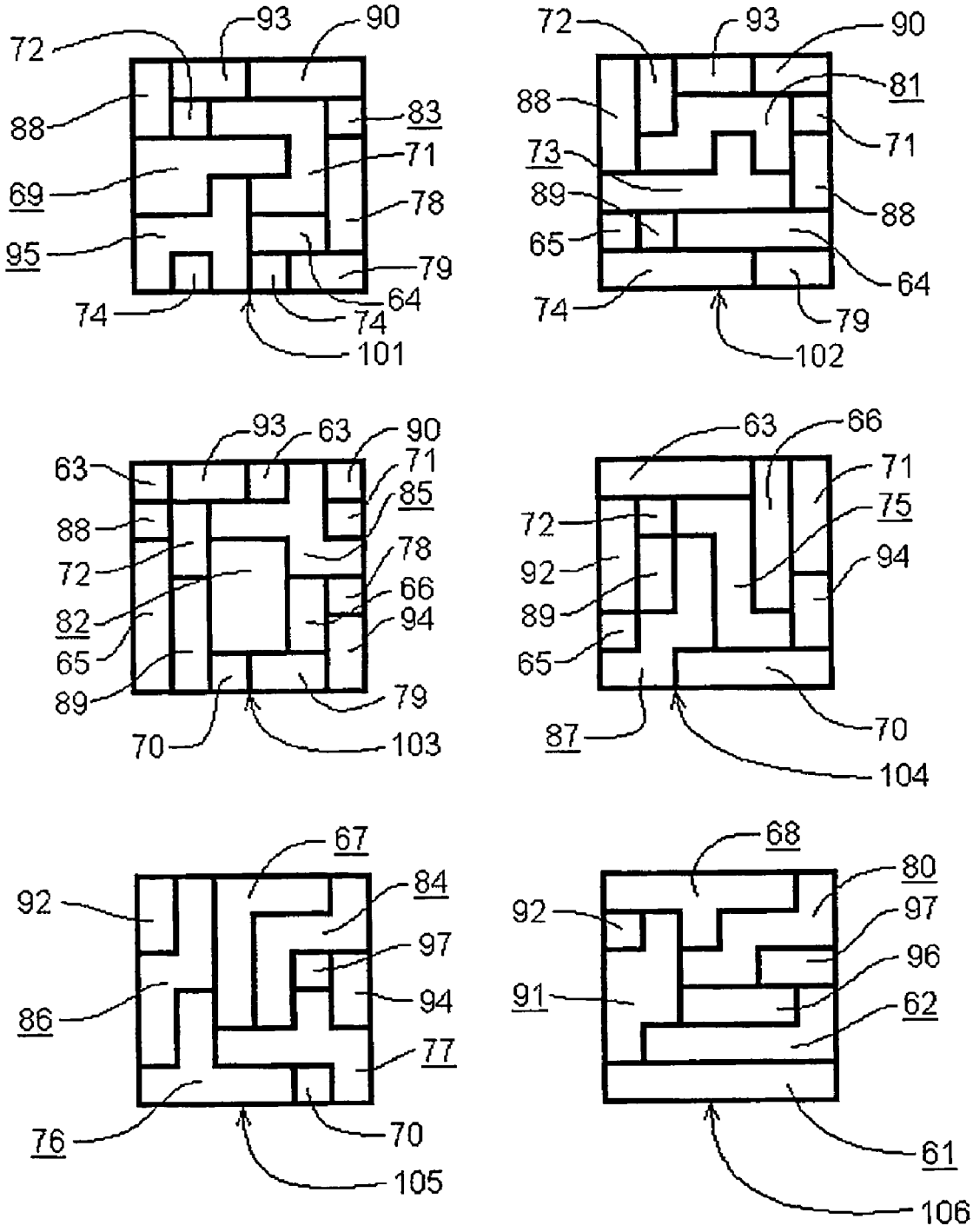
Figure 10:
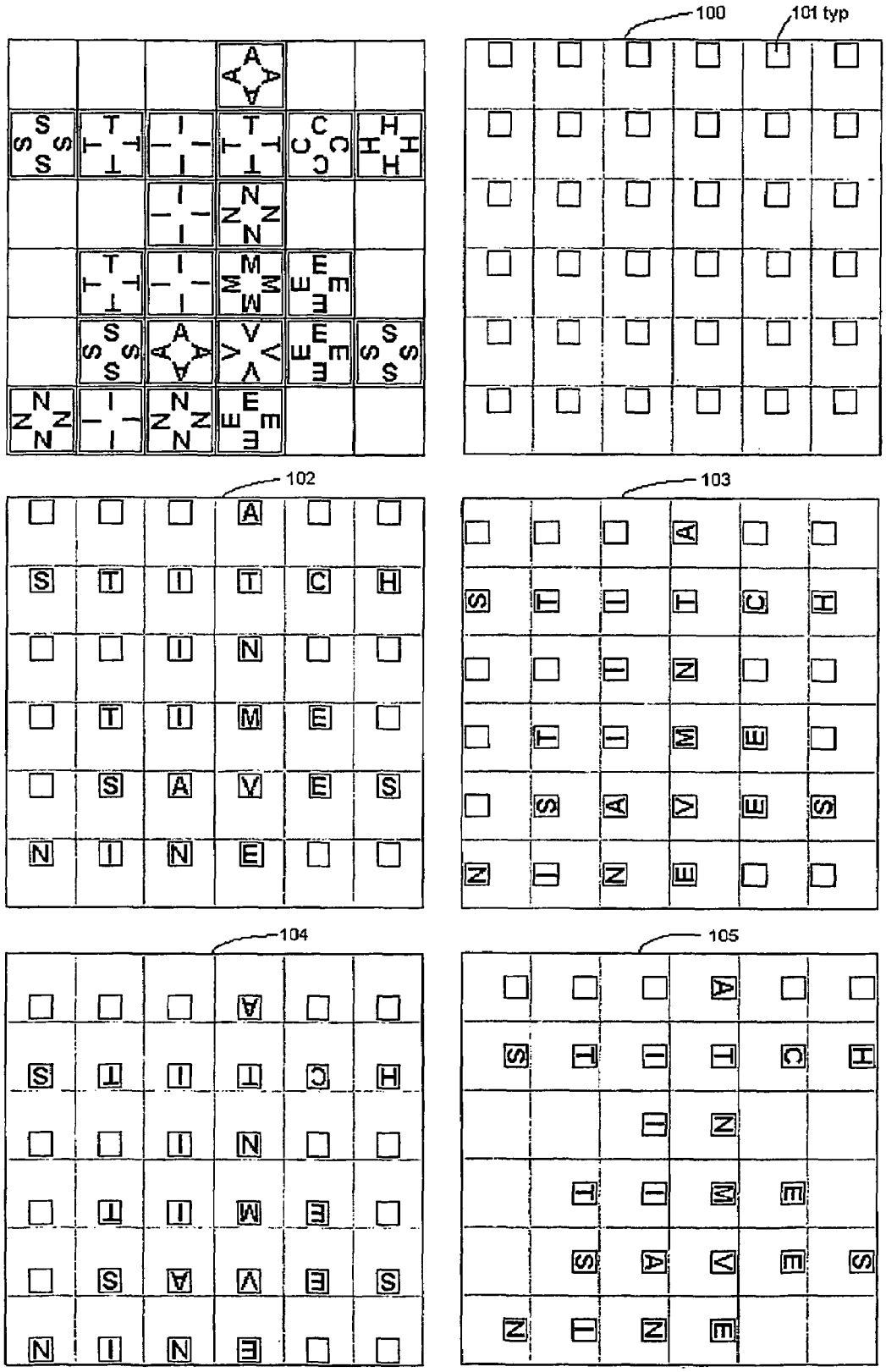
Figure 11:
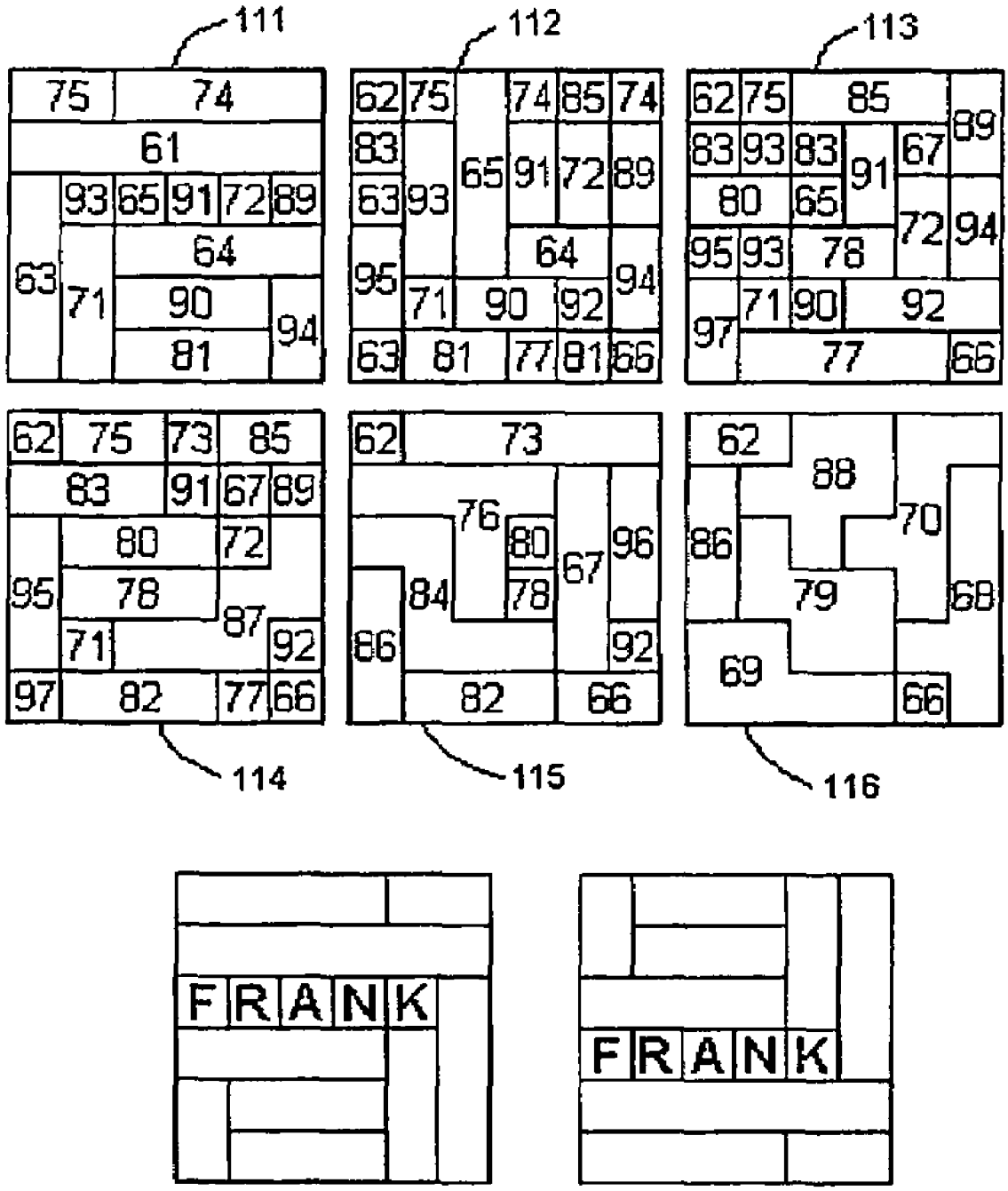

FIG. 4 collectively shows a further alternative pattern which may be assembled using the obverse faces of the puzzle pieces of FIG. 2, but also showing that the pattern may be reversed geometrically and with respect to colour using the same solution;

FIG. 5 collectively shows two solutions for a checkerboard pattern on the obverse faces of the puzzle pieces of FIG. 2;

FIG. 6 shows an example of a unique solution for a checkerboard pattern using the reverse faces of the puzzle pieces of FIG. 2;

FIG. 7 is an isometric view of a six-by-six-by-six cube puzzle according to the invention showing one particular solution;

FIG. 8 shows collectively one face of the thirty-seven pieces which make up the puzzle of FIG. 7;

FIG. 9 shows diagrammatically the solution to the puzzle shown in FIG. 7 using the pieces of FIG. 8;

FIG. 10 shows diagrammatically one face of the puzzle of FIG. 7 showing details of the layout of letters of a message in the form of Rosettes on some of the squares together with a mask shown separately and in four orientations covering three of the four letters;

FIG. 11 shows in diagrammatic form the solution for a puzzle similar to that of FIG. 1, but showing a form which may be inverted; and FIG. 12 is a copy of page 179 of the "Compendium of Checker Board Puzzles" by Jerry Slocum and Jacques Haubrich published August 1993 which demonstrates eighteen the puzzle pieces shown in FIG. 2.

DETAILED DESCRIPTION OF THE DRAWINGS

The kaleidoscope board puzzle 10 shown in FIG. 1 has an obverse face 11 and a reverse face 12 each comprising an array of eight by eight squares. The obverse face has two different markings, thirty-two squares each having a dark coloured marking corresponding to the dark square shown in the legend at 16 and thirty-two squares each having a horizontal striped marking corresponding to the horizontal striped square shown in the legend at 15. The reverse face has three different markings, thirty-two corresponding to the same dark colour as provided on the obverse face, sixteen each having a light coloured marking corresponding to the light square shown in the legend at 14 and sixteen squares each having a vertical striped marking corresponding to the vertical striped square shown in the legend at 16.

As shown in FIG. 2, the eighteen pieces making up the puzzle of FIG. 1 comprise two monominoes 21 and 22, a domino 23, two L-shaped triominoes 24 and 25 and two straight triominoes 26 and 27, ten tetrominoes comprising a square tetromino 28, a straight tetromino 29, four L-shaped tetrominoes 30, 31, 32 and 33, two T-shaped tetrominoes 34 and 35, and two S-or Z-shaped tetrominoes 36 and 37, and one straight octomino 38. It will be seen that these pieces are an example which satisfies the criteria of being the maximum number of pieces, all different in size, shape or colour, given that the markings form a checkerboard puzzle when the pieces are assembled together to form a square.

Figure 3:
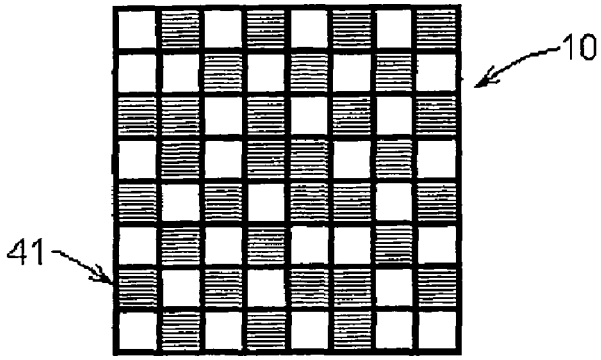
FIG. 3 shows an alternative pattern which may be assembled using the obverse faces of the puzzle pieces of FIG. 2.

The alternative pattern 41 shown in FIG. 3 has some of the pieces arranged such that when viewed at an angle of 45° counterclockwise to that shown, the letter "W" appears close to the centre of the board.

The further alternative pattern 42 shown in FIG. 4 may be interpreted as an elephant. The pattern may be reversed or inverted with respect to colour, as represented in the upper two dark coloured elephants with respect to the lower two light coloured elephants, and also reversed geometrically, as represented in the two examples to the left as compared to the two examples to the right. It can be seen that the geometrically reversed patterns also have the arrangement of the puzzle pieces reversed, bearing in mind that in order to "reverse" the arrangement, some of the puzzle pieces have to be swapped with other puzzle pieces having the same shape, but the alternative arrangement of colours on the squares of the respective pieces.

Two solutions 43 and 44 to the checkerboard pattern on the obverse face of the puzzle of FIG. 1 are shown in FIG. 5, these solutions being two of the twenty-billion or so solutions to the checkerboard according to the authors of the Compendium referred above, and as can be seen in the copy of page 179 shown in FIG. 12. The pattern shown at shown in FIG. 6 is one which has a unique solution, but other unique solutions would have a different pattern than the one shown by virtue of the definition of what constitutes a unique solution given above.

The cubic puzzle 60 shown in FIG. 7 comprises thirty-five hexominoes given reference numerals 61 through 95, and two triominoes 96 and 97 and also shown in FIG. 8. The cube has a front face 111, an end face 112 and atop face 113. (Some of the puzzle pieces in FIG. 8 are not visible in FIG. 7 because they are hidden by the other pieces.) In FIG. 9, the six "layers" 101 through 106 of the puzzle are shown giving a solution for solving the puzzle in which the puzzle pieces which are parallel to the page being given underlined reference numerals. It can be seen that the other reference numerals (which are not underlined) will appear in more than one layer. It can also be seen that pieces 61, 65, 70, 74, 76, 77, 79, 87, 89, 94 and 95 have at least one square visible on the front face; pieces 61, 63, 65, 68, 69, 73, 74, 76, 86, 87, 88, 91, 92 and 95 have at least one square visible on the end face; and pieces 61, 62, 68, 80, 86, 91, 92, 96 and 97 have at lease one face visible on the top face.

The face of the puzzle shown in FIG. 10 may be provided with a mask 100 having a plurality of apertures shown typically at 101. The apertures, which are square or rectangular, are spaced evenly and sized and aligned to be in register with one set of the four letters making up each Rosette on the respective squares on the face of the puzzle. The message "A stitch in time saves nine" is set out on the face of the puzzle, and it can be seen that with the mask in the correct orientation, the message is more easily read when aligned with the appropriate letter of the Rosettes as shown at 102. In the other three orientations, as shown at 103, 104 and 105, the message is not readily clear. Also note that the word "TIME" can be read diagonally from upper left to lower right in the view shown at 102 but in the view shown at 105 on turning counterclockwise it can be seen that the word reads from lower left to upper right.

The three-dimensional puzzle of the present invention has solutions showing a message on one side only, but is selected to provide a solution having messages on all six sides. For example, the phrase "a stitch in time saves nine" may be possible to arrange in several ways on one side of the puzzle cube, and yet may not necessarily be one of the phrases or proverbs comprised in another solution where there is more than one face of the cube having a phrase or proverb. There may also be solutions showing messages on two sides at once, or possible three sides at once. The solutions providing messages on up to five of the six sides may also include different messages from the messages comprised in the solution for the six sides. Moreover, the arrangement of the indicia may be selected such that the puzzler could find five of the six messages but the sixth side of the puzzle be provided with something other than an intelligible message, requiring a different solution to the puzzle to provide the solution having the six messages.

In the example shown in FIG. 11, the puzzle has on one face the letters spelling the name "FRANK". The puzzle is made up of the six layers 111, 112, 113, 114, 115 and 116, the word being viewed from "underneath" the bottom layer 111. However, in this example, the layers as shown may be reversed, to "invert" the solution. Moreover, when considered in the other two possible orientations, that is, front-to-back and left-to-right, the "layers" as such may be still be reversed to provide "inverted" solutions. If a word is made up of letters on the single-square end faces of pieces such as in the case of "FRANK" in this example, the word may also be reversed in the inversion process. It is believed that the rule, hereinbefore described, holds for the other two orientations of the layers.

The game or puzzle of the present invention may be used as a teaching aid for developing spatial thinking as well as for developing verbal thinking. Indeed, the game or puzzle of the present invention maybe used to develop both spatial and verbal thinking. It is believed that there are many aids for the development of verbal thinking, but relatively few for developing spatial thinking, and even fewer capable of developing both. Moreover, the method of exploiting the game or puzzle of the present invention over the Internet may be tailored to develop such thinking in individuals who participate in the solving of the puzzle, possibly with the participants being unaware that their spatial and verbal thinking skills are being so developed.

Although the invention has been described with reference to a number of specific examples, it will be appreciated by persons skilled in the art that the invention may be embodied in other forms without departing from the broad scope and ambit of the invention as herein set forth.

The invention claimed is:

1. A game or puzzle comprising a plurality of polyomino pieces, each piece having on opposite faces one or more squares, said squares on each said piece and on opposite faces having markings wherein such said markings of said squares in total on both faces of said pieces comprise four or more different markings such that:

said pieces are capable of being assembled using their obverse faces only into a first set of one pattern comprising squares with the markings of the squares on said obverse faces of said assembled pieces forming a checkerboard pattern of two alternating markings which may be used for playing a checkers or chess type game;

said pieces may be further assembled into a second set of one or more patterns using the reverse faces of some of the pieces and the obverse faces of the remaining pieces, each pattern in said second set comprising squares forming a further checkerboard pattern of four or more markings, one of said markings being in an alternating checkerboard pattern with the remaining markings; and said pieces may be further assembled into a third set of patterns using the reverse faces only of said pieces such that each pattern in said third set comprises three different markings on said reverse side which can be arranged into a pattern such that one of said markings forms a checkerboard pattern with the other two markings;

wherein the assembly of pieces forming said first set of patterns is different from the assembly required of pieces forming said second set of patterns.

2. A game or puzzle according to claim 1, wherein said plurality of polyomino pieces comprise a set of eighteen polyominoes consisting of a pair of monominoes, a pair of linear triominoes, a pair of angled triominoes, a pair of L-shaped tetrominoes, a pair of reverse L-shaped tetrominoes and a pair of T-shaped tetrominoes, one member of each said pair having the alternate markings on the squares on their obverse faces the opposite of the alternate markings of the other member of the pair, a pair of tetrominoes being an S-shaped tetromino and a Z-shaped tetromino a mirror image of the S-shaped tetromino, a duomino, a linear tetromino, a square tetromino and a linear octomino.

3. A game or puzzle according to claim 1, wherein said second set of patterns is selected to be of greater difficulty in solving than said first set of patterns.

4. A game or puzzle according to claim 3, wherein said first, said second and said third set of patterns are selected to be of a graded degree of difficulty for solving the game or puzzle.

5. A game or puzzle according to any one of the preceding claims, wherein said third set of patterns comprises unique solutions.

6. A game or puzzle according to claim 5, wherein the markings are selected from four different colours, one of which is common to both faces, whereby a fourth set of patterns can be determined which are aesthetically pleasing patterns instead of checkerboard patterns.

7. A game or puzzle according to claim 6, wherein said fourth set of patterns comprises unique solutions.

8. A game or puzzle comprising a plurality of polyomino pieces having an obverse face and a reverse face and squares having markings on each said face, wherein each puzzle piece is configured to a height the same dimension as the side of the squares making up the polyominoes such that the polyominoes are made up of a number of abutting cubes and having side faces made up of abutting squares, the markings on reverse and obverse faces and the side squares being selected to provide an indicium in at least some of said squares, such that the puzzle pieces may be assembled into one or more solutions comprising an assembled cube having a number of squares along each edge corresponding to the number of squares on the obverse and reverse faces, wherein at least one of said solutions comprises one or more messages on at least one of said faces of said assembled cube, said one or more messages being comprised of at least some of said indicia in said squares.

9. A game or puzzle according to claim 8, wherein all but two of the puzzle pieces are all hexominoes comprising the entire universe of all thirty-five different planar configurations that can be formed from six squares, each puzzle piece being configured to a height the same dimension as the side of the squares making up the hexominoes such that the hexominoes are made up of six abutting cubes, and the remaining puzzle pieces comprise two triominoes of different configuration, wherein there are only two different configurations for triominoes; the hexominoes having squares having different markings on each face or side, the markings being selected to provide an indicium in at least some of the squares such that the puzzle pieces may be assembled into one or more solutions comprising an assembled cube having six squares along each edge, wherein at least one of the solutions comprises one or more messages on at least one of the faces of the assembled cube, the one or more messages being comprised of the indicia in the squares.

10. A game or puzzle according to claim 8, wherein all but two of the puzzle pieces are all hexominoes comprising the entire universe of all thirty-Five different planar configurations that can be formed from six squares, each puzzle piece being configured to a height the same dimension as the side of the squares making up the hexominoes such that the hexominoes are made up of six abutting cubes, configuration, wherein there are only two different configurations for triominoes; the hexominoes having squares having different marking on each face or sides, the markings being selected to provide an indicium and the remaining puzzle pieces comprise two triominoes of different in at least some of the squares such that the puzzle pieces may be assembled into one or more solutions comprising an assembled cube having six squares along each edge, wherein at least one of the solutions comprises one or more messages on at least one of the faces of the assembled cube, the one or more messages being comprised of the indicia in the squares.

11. A game or puzzle according to claim 9, wherein said message includes one or more patterns of colours wherein the indicia in each consists of a plurality of colours.

12. A game or puzzle according to claim 9, wherein the indicia are in the form of language characters for the assembly of one or more verbal messages.

13. A game or puzzle according to claim 12, wherein one or more said patterns is in the form of a "Rosette" of particular patterns by the appropriate selection of characters and their respective arrangements on the squares.

14. A game or puzzle according to claim 12, wherein one or more of the messages are selected to be in the form of a proverb or saying using letters of an alphabetic language.

15. A game or puzzle according to claim 9, wherein one or more of the messages are selected to be in the form of a magic square wherein the indicia are in the form of numerals.

16. A game or puzzle according to claim 9, wherein one or more of the messages are selected to be in the form of prose or poetry in an ideographic language.

17. A game or puzzle according to claim 9, wherein the characters are provided in the form of Rosettes.

18. A game or puzzle according to claim 17, and including a mask having apertures in register with one of the letters of each Rosette.

19. A method of exploiting a game or puzzle according to claim 1, the method including:

selecting an arrangement of four different markings on the squares of the polyominoes;

publishing the arrangement of the polyominoes for a price;

offering a reward for the provision of a solution of any set of patterns, wherein the reward increases periodically to a maximum reward amount.

20. A method according to claim 19, and further including offering a relatively small reward for uploading of a new solution from any set of patterns.

21. A method according to claim 20, and further including offering an intermediate reward for uploading of a solution from the second set of patterns.

22. A method of exploiting a game or puzzle according to claim 8, the method including:

selecting an arrangement of four different markings on the squares of the polyominoes;

publishing the arrangement of the polyominoes for a price;

offering a reward for the provision of a solution comprising a message, wherein the reward increases periodically to a maximum reward amount.

23. A method according to claim 19, wherein the publication is by way of an Internet website and the price is payable in order to gain access to the arrangement of the polyominoes and/or a website form for uploading a proposed solution to a pattern.

* * * * *